United States Patent [19]

Tsuchida et al.

[11] Patent Number: 4,543,382

[45] Date of Patent: Sep. 24, 1985

[54] PLASTIC MAGNETS IMPREGNATED WITH A DYE-COATED MAGNET ALLOY POWDER

[75] Inventors: Michinori Tsuchida, Ibaraki; Toshihide Shimizu, Urayasu; Ichiro Kaneko; Tokuji Abe, both of Ibaraki, all of Japan

[73] Assignee: Shin-Etsu Chemical Co., Ltd., Tokyo, Japan

[21] Appl. No.: 561,552

[22] Filed: Dec. 14, 1983

[30] Foreign Application Priority Data

Dec. 14, 1982 [JP] Japan ..... 57-219600
Mar. 31, 1983 [JP] Japan ..... 58-56333

[51] Int. Cl.[4] ..... H01F 1/06; H01F 7/02

[52] U.S. Cl. ..... 524/267; 252/62.54; 524/439; 524/440; 524/606; 428/403; 428/900

[58] Field of Search ..... 428/900, 403, 408, 329; 427/127; 252/62.51 R, 62.54, 62.52; 524/267, 439, 440, 606

[56] References Cited

U.S. PATENT DOCUMENTS 3,502,583 3/1970 Graham ..... 252/62.52
3,989,648 11/1976 Lenhard et al. ..... 428/403
4,190,548 2/1980 Baermann ..... 252/62.54
4,308,155 12/1981 Tada et al. ..... 252/62.54
4,309,480 1/1982 Armanini ..... 428/403
4,374,676 2/1983 Senda et al. ..... 428/403
4,421,660 12/1983 Hajna ..... 252/62.54
4,434,009 2/1984 Banba ..... 428/407
4,443,527 4/1984 Heikens et al. ..... 428/407
4,497,722 2/1985 Tsuchida et al. ..... 428/900

*Primary Examiner*—George F. Lesmes
*Assistant Examiner*—William M. Atkinson
*Attorney, Agent, or Firm*—Toren, McGeady, Stanger, Goldberg & Kiel

[57] ABSTRACT

The invention provides a very simple but effective means for preventing surface oxidation of fine metal powders by coating the metal powder with an organic dye. This method of surface-oxidation prevention is particularly useful for the preparation of a so-called plastic magnet which is prepared by uniformly blending a dye-coated fine powder of a magnetic alloy such as a rare earth-cobalt based permanent magnet with a thermoplastic resin such as a nylon or polyphenylene sulfide resin followed by molding the resin-powder blend into a magnet form. In addition to the remarkably improved magnetic properties of the thus prepared plastic magnets as a result of high loading and absence of degradation by oxidation, the danger of spontaneous ignition of the magnet powder in molding can be eliminated almost completely. Surface treatment of the dye-coated magnet powder with a silicone fluid gives further improved results.

4 Claims, No Drawings

PLASTIC MAGNETS IMPREGNATED WITH A DYE-COATED MAGNET ALLOY POWDER

BACKGROUND OF THE INVENTION

The present invention relates to a metal powder coated with an organic dye and a polymeric shaped article impregnated or filled with such a dye-coated metal powder or, in particular, a so-called plastic magnet impregnated with a dye-coated metallic magnet powder.

In recent years, wide applications are found by a variety of polymeric compositions impregnated or filled with a fine metallic powder utilizing their unique electric and magnetic properties along with the development of the electronic technology. Such polymeric compositions including coating compositions, e.g. paints, rubbers and plastics have both of the advantages of the polymeric materials, e.g. moldability and flexibility, and the metallic components, e.g. electroconductivity and magnetism.

The finely divided metallic dispersant used in these composite materials are formed of fine particles, fibrils, flakes or chips and these powders have an extremely large surface area per unit volume. A problem accompanying the extremely large surface area and the high surface activity of the metallic powder is the high susceptibility thereof to oxidation by the atmospheric oxygen which adversely affects the performance of the composite materials filled with such a surface-oxidized metallic powder. For example, an excessively high oxidizability of the metal powder sometimes causes fire by the spontaneous oxidation in the course of the fabrication of the polymer-based composition at an elevated temperature to decrease the yield of the acceptable products. In addition, the oxidation of the metal powder is responsible to the shortened serviceable life of the products filled with the metal powder in the long-run use.

In connection with so-called plastic magnets, i.e. permanent magnets of a magnetic powder dispersed in a matrix of or shaped with a plastic resin, as a type of the above mentioned metal powder-filled polymeric composite materials, plastic magnets have several advantages over other types of permanent magnets prepared by the powder metallurgical process or by casting of a molten magnetic metal or alloy which suffer from the disadvantages of the extremely high costs for the preparation of a magnet of a complicated configuration with high precision of the dimensions, difficulties in obtaining a uniform distribution of the magnetism in the magnet, difficulties in the integration of the magnet with other parts and difficulties in the preparation of a radially anisotropic or multipolar anisotropic magnet due to cracking. Plastic magnets are outstandingly advantageous in these respects.

As is well known, the magnetic powder used in plastic magnets at the early stage of the development thereof has been the magnetic ferrites due to the inexpensiveness and stability against oxidation. In recent years, however, more powerful plastic magnets are required with reduction in size and weight so that the ferrite powders are being replaced with metallic permanent magnets with higher magnetic performance such as the rare earth-cobalt based permanent magnets.

While the powder of such a rare earth-cobalt magnet as a magnet powder in plastic magnets is unquestionably excellent in the magnetic performance over the conventional ferrites, a problem in the use of a metallic magnet powder as a magnet powder in plastic magnets is the oxidation by the atmospheric oxygen so that rare earth-cobalt based magnet powders rapidly lose their magnetic properties when heated in a high temperature atmosphere of air at 200° to 250° C. or higher in addition to the danger of ignition in the course of the fabrication of the composition.

Several methods have been proposed, of course, for the prevention of surface oxidation of fine metallic powders including (1) the method of ion plating and (2) the method of coating with a synthetic resin for the surface treatment. The method of ion plating is, however, economically disadvantageous because the method is performed by use of a specific apparatus with a large consumption of energy along with the very low productivity. The method of resin coating is, on the other hand, not free from the problems that the electric conductivity of the composition filled with such a resin-coated metal powder is necessarily remarkably decreased and the coating film of the resin is readily destroyed resulting in the loss of protection against air oxidation.

Limiting the subject matter to the plastic magnets filled with a powder of rare earth-cobalt magnets, several measures have been proposed to get rid of the problem of the air oxidation of the magnet powder as follows.

(1) Blending of the magnet powder with a plastic resin is performed in an atmosphere of an inert gas. This method is indeed effective to some extent to prevent air oxidation of the magnet powder although the effect can never be complete and the method necessarily leads to the decrease in the productivity and increase in the production cost.

(2) The magnet powder is treated in advance for surface coating with a titanium-containing or silane-based surface treatment agent. This method is also effective to some extent but the effect can never be complete and hardly be expected at 300° C. or higher.

(3) Plastic magnets are prepared by use of a plastic resin having a sufficient flowability at a relatively low temperature so that the shaping of the plastic magnet by molding can be performed at a correspondingly low temperature consequently with little oxidation of the magnet powder. A problem in this method is, as a matter of course, the correspondingly low upper limit of the usable temperature range of the plastic magnet and, in addition, such a plastic magnet exhibits a relatively rapid decrease in the magnetic properties in the course of long-run use.

(4) The plastic magnet is prepared with a decreased loading amount of the magnet powder in the matrix of the plastic resin. Such a method is, however, applicable only when no high performance plastic magnet is desired.

Thus, no effective and convenient method is known in the prior art for preventing surface oxidation of a metal powder as a dispersant in a polymer-based composite material or, in particular, preventing surface oxidation of a powder of a metallic magnet as a magnetic dispersant in a plastic magnet.

SUMMARY OF THE INVENTION

It is therefore an object of the present invention to provide a novel and improved method for effectively and conveniently preventing surface oxidation of a fine metal powder.

Another object of the invention is to provide a plastic magnet filled with a powder of a metallic magnet as the magnetic dispersant in a plastic resin which is outstandingly stable against the adverse effect caused by the surface exidation of the magnet powder by the atmospheric oxygen not only in the course of the preparation thereof but also in respect of aging of the magnetic properties in time caused by the oxidation of the magnet powder.

The fine metal powder of the present invention outstandingly stabilized against oxidation by the atmospheric oxygen is a powder composed of metal particles coated on the surface with an organic dye.

Such a dye-coated metal powder can readily be prepared by wetting the metal powder with a solution containing an organic dye dissolved therein followed by drying.

Further, the plastic magnet provided by the invention comprises a synthetic plastic resin as a matrix and a powder of a metallic magnet uniformly dispersed in the matrix, the particles of the powder being coated on the surface with an organic dye, preferably, in a coating amount of 0.02 to 2% by weight based on the magnetic powder. In addition, it was found that a treatment of the dye-coated magnetic powder with a silicone fluid before incorporation into the matrix of the plastic resin had an effect of further increasing the oxidation preventing effect. The blending ratio of resin to coated powder is in the range from 92:8 to 5:95 by weight.

DETAILED DESCRIPTION OF THE PREFERRED EMBODIMENTS

As is mentioned above, the principle of the present invention is very simple and an unexpectedly high efficiency is obtained for preventing surface oxidation of a metal powder or, in particular, a fine powder of a metallic magnet by the atmospheric air. The mechanism to explain such a high efficiency is not quite clear but it is presumable that an organic dye is absorbed on the surface of the metal particles by the secondary bonding to form a thin layer which effectively shields the surface from atmospheric oxygen coming into contact with the metal surface by virtue of the specific molecular structure inherent to organic dyes in general. Further, the molecular structure specific to organic dyes has a semiconductive nature so that the adverse effect on the electric properties of the coated metal particles by the coating layer can be minimized different from the conventional coating method with a synthetic resin.

The metal powder as the base material of the inventive stabilized metal powder is not particularly limitative in respect of the morphology of the particles including dusty particles, grains, ribbons, fibrils or fibers, flakes, fragments of foils, chips and the like. In addition, certain shaped metallic bodies, such as Rschig rings used in a distillation column, can be stabilized according to the invention. The relative effectiveness of the inventive method is of course increased as the increase in the specific surface area of the metal powder per unit volume of the metal, for example, over 40 $cm^2/cm^3$.

The method of the inventive method is effective to any metallic powder including various kinds of metals, alloys, intermetallic compounds, metal-containing composite materials and the like provided that the metallic material is susceptible to oxidation by the atmospheric oxygen.

The organic dyes used for forming a coating layer on the metal particles include direct dyes, acid dyes, basic dyes, mordant dyes, sulfur dyes, vat dyes, disperse dyes, oil soluble dyes and reactive dyes as well as fluorescent brightening agents. Several examples of the particularly effective dyes belonging to each of these classes are as follows.

Direct dyes: C.I. Direct Yellow 26; 28; 39; 44; 50; 86; 88; 88; 89; 98; and 100; C.I. Direct Orange 39; 51; and 107; C.I. Direct Red 79; 80; 81; 83; 84; 89; and 218; C.I. Direct Green 37; and 63; C.I. Direct Violet 47; 51; 90; and 94; C.I. Direct Blue 71; 78; 86; 90; 98; 106; 160; 194; 196; 202; 225; 226; and 246; C.I. Direct Brown 95; 106; 170; 194; and 211; C.I. Direct Black 19; 32; 51; 75; 94; 105; 106; 107; 108; 113; 118; and 146.

Acid dyes: C.I. Acid Yellow 7; 17; 23; 25; 40; 44; 72; 75; 98; 99; 114; 131; and 141; C.I. Acid Orange 19; 45; 74; 85; and 95; C.I. Acid Red 6; 32; 42; 52; 57; 75; 80; 94; 111; 114; 115; 118; 119; 130; 131; 133; 134; 145; 168; 180; 184; 194; 198; 217; 249; and 303; C.I. Acid Violet 34; 47; and 48; C.I. Acid Blue 15; 29; 43; 45; 54; 59; 80; 100; 102; 113; 120; 130; 140; 151; 154; 184; 187; and 229; C.I. Acid Green 7; 12; 16; 20; 44; and 57; C.I. Acid Brown 39; and 301; C.I. Acid Black 2; 24; 26; 29; 31; 48; 52; 63; 131; 140; and 155

Basic dyes: C.I. Basic Yellow 11; 14; 19; 21; 28; 33; 34; 35; and 36; C.I. Basic Orange 2; 14; 21; and 32; C.I. Basic Red 13; 14; 18; 22; 23; 24; 29; 32; 35; 36; 37; 38; 39; and 40; C.I. Basic Violet 7; 10; 15; 21; 25; 26; and 27; C.I. Basic Blue 54; 58; and 60; C.I. Basic Black 8

Mordant dyes: C.I. Mordant Yellow; 1, 23; and 59; C.I. Mordant Orange 5; C.I. Mordant Red 21; 26; 63; and 89; C.I. Mordant Violet 5; C.I. Mordant Blue 1; 29; and 47; C.I. Mordant Green 11; C.I. Mordant Brown 1; 14; and 87; C.I. Mordant Black 1; 3; 7; 9; 11; 13; 17; 26; 38; 54; 75; and 84

Sulfur dyes: C.I. Sulfur Orange 1; and 3; C.I. Sulfur Blue 2; 3; 6; 7; 9; and 13; C.I. Sulfur Red 3; and 5; C.I. Sulfur Green 2; 6; 11; and 14; C.I. Sulfur Brown 7; and 8; C.I. Sulfur Yellow 4; C.I. Sulfur Black 1; C.I. Solubilized Sulfur Orange 3; C.I. Solubilized Sulfur Yellow 2; C.I. Solubilized Sulfur Red 7; C.I. Solubilized Sulfur Blue 4; C.I. Solubilized Sulfur Green 3; C.I. Solubilized Sulfur Brown 8

Vat dyes: C.I. Vat Yellow 2; 4; 10; 20; 22; and 23; C.I. Vat Orange 1; 2; 3; 5; and 13; C.I. Vat Red 1; 10; 13; 16; 31; and 52; C.I. Vat Violet 1; 2; and 13; C.I. Vat Blue 4; 5; and 6; C.I. Solubilized Vat Blue 6; C.I. Vat Blue 14; 29; 41; and 64; C.I. Vat Green 1; 2; 3; 8; 9; 43; and 44; C.I. Solubilized Vat Green 1; C.I. Vat Brown 1; 3; 22; 25; 39; 41; 44; and 46; C.I. Vat Black 9; 14; 25; and 57

Disperse dyes: C.I. Disperse Yellow 1; 3; and 4; C.I. Disperse Red 12; and 80: C.I. Disperse Blue 27

Oil soluble dyes: C.I. Solvent Yellow 2; 6; 14; 19; 21; 33; and 61; C.I. Solvent Orange 1; 5; 6; 37; 44; and 45; C.I. Solvent Red 1; 3; 8; 23; 24; 25; 27; 30; 49; 81; 82; 83 84; 100; 109; and 121: C.I. Solvent Violet 1; 8; 13; 14; 21; and 27; C.I. Solvent Blue 2; 11; 12; 25; 35; 36; 55; and 73; C.I. Solvent Green 3; C.I. Solvent Brown 3; 5; 20; and 37; C.I. Solvent Black 3; 5; 7; 22; 23; and 123

Reactive dyes: C.I. Reactive Yellow 1; 2; 7; 17; and 22; C.I. Reactive Orange 1; 5; 7; and 14; C.I. Reactive Red 3; 6; and 12; C.I. Reactive Blue 2; 4; 5; 7; 15; and 19; C.I. Reactive Green 7; C.I. Reactive Black 1

Fluorescent brightening agents: C.I. Fluorescent Brightening Agent 24; 84; 85; 91; 162; 163; 164; 167; 169; 172; 174; 175; and 176

The above listed oraganic dyes are used either singly or as a combination of two kinds or more according to need in the form of a solution containing from 0.05 to 5% by weight of the dye or dyes in a suitable solvent such as water or an organic solvent according to the solubility behavior of the dyes. The dye-coated metal powder of the invention can be prepared by wetting the starting metal powder with the dye solution, i.e. dipping the metal powder in the solution or spraying the solution on to the metal powder, followed by evaporation of the solvent to dryness without or with heating up to a temperature of about 150° C.

Suitable solvents for dissolving the organic dyes are exemplified by water and organic solvents such as alcoholic solvents, aliphatic hydrocarbon solvents, aromatic hydrocarbon solvents, halogenated hydrocarbon solvents, ketone solvents, ester solvents, ether solvents and the like. These solvents may be used either singly or as a mixture of two kinds or more according to need.

The dye-coated metal powder of the invention obtained in the above described manner is advantageous practically in several respects that, for example (1) the powder can be stored for a long period of time without being sealed in an atmosphere of an inert gas, (2) the powder can be handled in an atmosphere of air without particular carefulness since the powder is less susceptible to the oxidation by the atmospheric oxygen, (3) the polymeric composition impregnated with a metal powder can be produced with uniform quality in an increased yield because of the stability of the metal powder against air oxidation and the absence of the danger of fire even at an elevated temperature for polymer processing, and (4) the polymeric composite material impregnated with the metal powder is resistant to aging in time and has a long serviceable life due to the stability of the metal powder against oxidation. Therefore, the dye-coated fine metal powder of the invention is useful as a dispersant in various kinds of polymer-metal powder composite materials of high performance such as plastic magnets, metal-coated recording tapes and discs, shielding materials of electromagnetic waves, flexible heater elements and the like.

When the metal powder coated with the organic dye is a powder of a metallic magnet and the dye-coated magnetic powder is used as the magnetic dispersant in a plastic magnet, several advantages are obtained as described below.

(1) The dye-coated metallic magnet powder is stable against oxidation by the atmospheric air even at a temperature of, for example, 300° C. or higher sometimes encountered in the molding process of the plastic magnet without the danger of denaturation by oxidation or spontaneous ignition so that plastic magnets of high and uniform characteristics can readily be obtained.

(2) The stability of the magnet powder at high temperatures gives a possibility of using a specific engineering plastic resin which should be molded at a relatively high temperature, such as polyphenylene sulfide resins and polyphenylene oxide resins, as the matrix plastic without particular problems and the polymeric composition composed of such a plastic resin and a large amount of the dye-coated metallic magnet powder can be shaped readily by injection molding, extrusion molding and the like method into a plastic magnet which can be used at elevated temperatures with high reliability and free from deterioration of the magnetic properties over a very long period of time.

(3) Radially anisotropic or radially multipolar plastic magnets of high performance can readily be prepared.

(4) Plastic magnets of complicated forms including those integrated with other parts can be easily shaped so that great reduction is obtained in the costs for the postworking of the molded plastic magnets.

(5) The plastic magnets are uniform in the magnetic properties and have a high impact strength so that they are used advantageously in electric instruments subject to mechanical shocks such as relays and buzzars.

(6) The dye-coated magnet powder is stable against denaturation by oxidation and free from the danger of ignition even by molding at an elevated temperature as is mentioned above so that the production of the plastic magnets can be performed with safety and with good quality control and the plastic magnets can be re-used by reclaiming without decrease in the magnetic properties.

The above described advantages obtained by the dye-coating of the metallic magnet powder as the dispersant in the plastic magnets are not limited to a particular metallic magnet but the principle of the inventive method is applicable to any metallic permanent magnets. The advantages of the inventive method are, however, most remarkable when the metallic magnet powder is a fine powder of a rare earth-cobalt based permanent magnet.

Several types of the rare earth-cobalt magnets are known including those having a composition of a rare earth element and cobalt alone and those having a composition of a rare earth element and cobalt admixed with certain other transition metals expressed by the general formula $R(Ca,Cu,Fe,M)_z$, in which R is a rare earth element such as samarium and cerium or a combination of rare earth elements, M is an element belonging to the IVth, Vth, VIth or VIIth Group of the Periodic Table, such as titanium, zirconium, hafnium, vanadium, niobium, tantalum, molybdenum, chromium, tungsten and maganese, or a combination thereof and z is a positive number usually in the range from 5 to 9.

The particle size of the metallic magnet powder is preferably in the range from 0.1 to 10 $\mu$m in the case of a rare earth-cobalt magnet of the formula $RCo_5$ type. A magnet powder coarser than 10 $\mu$m has a somewhat decreased coercive force in addition to an increase in the variation of the magnetic properties of the plastic magnets. On the other hand, a magnet powder finer than 0.1 $\mu$m is undesirable due to the instability with increased activity as a powder. The magnet powder of the spinodal decomposition type rare earth-cobalt-based magnetic alloy is prepared by pulverizing a magnet of the alloy having optimized magnetic properties as obtained in the conventional powder metallurgical process including pulverization of the alloy in the monocrystalline or polycrystalline form, shaping of the powder by molding in a mgnetic field, sintering and aging. The particle size limitation in this case should be determined in consideration of the application of the plastic magnet and handling of the materials under manufacturing. When a high loading of the magnet powder is desired, for example, it is preferable that the magnet powder is a blend of a very fine powder and a powder of somewhat coarser particle size. Multipolar, radially anisotropic plastic magnets should be prepared of a magnet powder having a sufficiently small particle size of, for example, one tenth or smaller of the dimension of the poles.

The preferable organic dyes for providing dye-coating on the magnet powder and the procedure for coating may be the same as described before for metal powders in general and not repeated here. The amount of dye coating on the magnet powder should be in the range from 0.02 to 2% by weight or, preferably, from 0.05 to 1% by weight of the powder. When the coating amount is smaller than above, the oxidation preventing effect may be insufficient while too much amounts of dye coating result, even by setting aside the problem of the increased cost, in decreased flowability of the polymer-powder composition with a decreased relative proportion of the plastic resin to cause difficulties in high loading of the plastic magnet with the magnet powder. As is described later, the amount of dye coating can be reduced when dye coating is followed by a treatment of the powder with a silicone fluid.

Alternatively, the dye coating of the magnet powder is preceded preferably by a surface treatment with a titanium-containing compound, silane compound, silicone or other polymeric compound.

As is mentioned above, an effecitve way to reduce the amount of dye coating is the post-treatment of the dye-coated magnet powder with a silicone fluid according to need. This silicone treatment of the dye-coated magnet powder has an effect of better oxidation prevention than in the dye-coated powder as such and an effect of increasing the lubricity in the shaping of the plastic composition into plastic magnets. The silicone fluids suitable for the purpose are exemplified by dimethyl silicone fluids, methylphenyl silicone fluids and various kinds of modified silicone fluids as well as the silicone fluids, e.g. dimethyl silicone fluids, admixed with an oiliness improver. The viscosity of the silicone fluid is not particularly limitative in a wide range.

The silicone treatment of the dye-coated magnet powder is performed by wetting the powder with a solution of the silicone followed by drying. The solvent to dissolve the silicone is not particularly limitative provided that it has a good dissolving power to the silicone and, preferably, good vaporizability in drying. The concentration of the silicone in the solution is usually in the range from 0.01 to 10% by weight. The dye-coated magnet powder is wetted with the solution by dipping in the solution or by spraying of the solution and dried at room temperature or by heating at a temperature of about 150° C. or below.

The amount of the silicone fluid left on the particles of the magnet powder is usualy in the range from 0.02 to 2% by weight or, preferably, from 0.05 to 1% by weight of the magnet powder. When the amount of the silicone coating is smaller than above, no desired improving effect of the oxidation resistance can of course be obtained while a too much amount of the silicone fluid reduces the compatibility of the powder and the plastic resin so that difficulties are encountered in obtaining high loading of the composition with the magnet powder.

The resin to be blended with the dye-coated magnet powder and form the matrix of the plastic magnet is a thermoplastic resin and various kinds of thermosplastic resins in general are suitable for the purpose. Several examples of the resins include the general-purpose plastic resins such as polyethylene, polypropylene, polystyrene, polyvinyl chloride, acrylic resins and the like and the so-called engineering plastic resins such as nylon, polysulfone resins, polyphenylene sulfide resins, polyphenylene oxide resins and the like though not limited thereto.

The present invention can provide a plastic magnet composition with an extremely high content of the magnet powder. For example, the content of the magnet powder in the composition can be as high as about 95% by weight. In contrast thereto, no such a high-loaded plastic magnet compositions can be obtained in the prior art due to the difficulties in respect of the moldability and magnetic orientation. Thus, the plastic magnets according to the present invention are much superior to those of the prior art in the magnetic properties. It is of course that the magnetic properties of a plastic magnet largely depend on the content of the magnet powder therein so that the content of the dye-coated magnet powder in the inventive plastic magnet composition should not be lower than 8 to 10% by weight.

The shaping method of the inventive plastic magnet is not particularly limitative including conventional methods such as injection molding, extrusion molding, compression molding and the like.

The dye-coated metallic magnet powder is highly stable against oxidation by the atmospheric air so that the powders need not be stored under a sealed condition in an atmosphere of an inert gas but may be stored for a long period of time under the atmospheric air. Further, the powder can be shaped into a plastic magnet without the disadvantage of deterioration by air oxidation or ignition even when contacted with the air at an elevated temperature in a high yield of acceptable products having well controlled quality. The product magnets are free from degradation of the magnetic properties by oxidation for a long term and have a very long serviceable life.

In the following, the dye-coated metal powders and the plastic magnet composition impregnated with such a dye-coated metallic magnet powder according to the invention are illustrated in more detail by way of examples.

EXAMPLE 1

About 1 g of a metal powder taken by exact weighing was shaken in a stoppered bottle with 1 g of a 0.5% by weight solution of C.I. Solvent Black 7 in a 1:1 by weight mixture of toluene and methyl alcohol to effect uniform adsorption of the dye on the metal powder followed by drying at 60° C. to evaporate the solvent and then heating at 110° C. for 1 hour.

The resistance of the thus dye-coated metal powder against air oxidation was examined by heating the powder at 250° C. for 20 minutes in an air circulation oven to calculate the value of weight increase in % dividing the weight increase of the dye-coated metal powder in the heat treatment at 250° C. by the weight of the metal powder before dye coating. This test was undertaken with three kinds of metal powders to give the results shown in Table 1 below together with the comparative results obtained with the same powders without dye coating. The metal powders tested were as follows.

(1) Copper: C-3, a product by Fukuda Metal Foils and Powders Industry Co.: apparent density 0.8 to 1.3 g/cm$^3$; purity at least 98.5%; particle size distribution, less than 2% of coarser particles than 200 mesh, 5 to 20% of particles in the range of 200 to 250 mesh, 5 to 20% of particles in the range of 250 to 350 mesh and 68 to 85% of finer pariticles than 350 mesh.

(2) Electrolytic iron: Fe-S-200, a product by the same company as above; apparent density 2.1 to 2.7 g/cm$^3$; purity at least 99.5%; particle size distribution, less than 5% of coarser particles than 200 mesh, less than 10% of particles in the range of 200 to 250 mesh, less than 15% of particles in the range of 250 to 350 mesh and at least 70% of finer particles than 350 mesh.

(3) Rare earth-cobalt magnetic powder: R-22, a product by Shin-Etsu Chemical Co.; average particle size by the Fischer's method about 3 μm

TABLE 1

| Metal powder | Dye-coated powder | Uncoated powder |
|---|---|---|
| Copper | +0.3% | +5.5% |
| Electrolytic iron | +0.1% | +0.8% |
| Magnetic alloy | +0.7% | +14.7% |

As is understood from the results shown in the above table, dye-coating of a metal powder is very effective in preventing oxidation of the metal powder by the atmospheric air. The effect is most remarkable in the case of the rare earth-cobalt based magnetic alloy powder.

EXAMPLE 2

Substantially the same experimental procedure as in Example 1 was repeated each time by use of about 2 g of the same magnetic alloy powder as in Example 1 and a dye solution which was a 0.5% by weight solution of either one of the organic dyes shown in Table 2 below to give a coating amount of the dye also shown in the table. Table 1 also gives the results of the weight increase in % of the dye-coated powder by heating at 250° C. for 20 minutes.

TABLE 2

| Coating material | Solvent | Coating amount, % | Weight increase, % |
|---|---|---|---|
| None | — | — | 15.0 |
| Silane coupling agent | Toluene | 0.3 | 3.5 |
| Titanate compound | Toluene | 0.4 | 4.6 |
| Epoxy resin | Toluene | 5.5 | 3.0 |
| C.I. Direct Blue 202 | Water | 0.5 | 0.6 |
| C.I. Direct Violet 47 | Water | 0.5 | 0.6 |
| C.I. Direct Black 113 | Water | 0.5 | 0.6 |
| C.I. Acid Black 2 | Water | 1.0 | 0.2 |
| C.I. Acid Black 2 | Water | 0.5 | 0.6 |
| C.I. Acid Black 2 | Water | 0.1 | 0.9 |
| C.I. Acid Black 2 | Water | 0.05 | 1.3 |
| C.I. Acid Violet 34 | Water | 0.6 | 0.5 |
| C.I. Acid Yellow 114 | Water | 0.5 | 0.8 |
| C.I. Basic Orange 2 | Water | 0.5 | 0.5 |
| C.I. Basic Orange 14 | Methanol | 0.5 | 0.5 |
| C.I. Basic Red 40 | Methanol | 0.5 | 0.4 |
| C.I. Mordant Brown 87 | Water | 0.5 | 0.4 |
| C.I. Mordant Black 84 | Water | 0.5 | 0.5 |
| C.I. Sulfur Blue 7 | Water | 1.2 | 0.4 |
| C.I. Sulfur Green 6 | Water | 0.5 | 0.6 |
| C.I. Vat Orange 2 | Xylene | 0.5 | 0.6 |
| C.I. Disperse Yellow 1 | Acetone | 0.5 | 0.6 |
| C.I. Disperse Red 12 | Ethanol | 0.4 | 0.5 |
| C.I. Solvent Yellow 2 | Toluene | 0.3 | 0.3 |
| C.I. Solvent Yellow 61 | Toluene | 0.3 | 0.3 |
| C I. Solvent Red 100 | Ethanol | 0.4 | 0.4 |
| C I. Solvent Violet 21 | Methanol | 0.2 | 0.6 |
| C.I. Solvent Blue 36 | Acetone | 0.2 | 0.6 |
| C.I. Solvent Green 3 | Toluene | 0.4 | 0.5 |
| C.I. Solvent Black 7 | Toluene | 0.5 | 0.3 |
| C.I. Solvent Black 7 | Toluene | 0.1 | 0.6 |
| C.I. Solvent Black 7 | Toluene | 0.05 | 1.0 |
| C.I. Reactive Blue 19 | Water | 0.5 | 0.7 |
| C.I. Reactive Black 1 | Water | 0.4 | 0.6 |
| C I. Fluorescent Brightening Agent 176 | Water | 0.2 | 0.5 |
| C.I. Acid Black 2 + C.I. Basic Orange 14 (7:3) | Water | 0.3 | 0.5 |

Table 2 also includes the results of the comparative tests in whcih the magnetic alloy powder was coated with 3% of an epoxy resin (Epikote 828, a product by Shell Chemical Co.) admixed with 2% of an adhesive (Cemedyne Co.) followed by curing at 150° C. for 1 hour, with a silane coupling agent (KBM 603, a product by Shin-Etsu Chemical Co.) or a titanate compound (KR-TTS, a product by Ajinomoto Co.). The results of these comparative tests were very poor in comparison with the results of the dye-coated powders indicating a great weight increase by the heating treatment at 250° C.

EXAMPLE 3

One hundred parts by weight of the same magnetic alloy powder as used in Example 1 were admixed and blended with 50 parts by weight of a toluene solution containing 0.5% by weight of an organic dye shown in Table 3 below followed by evaporation of the solvent at 60° C. and then heating at 110° C. for 1 hour and 435 g of the thus dye-coated magnet powder and 65 g of a nylon resin (UBE Nylon 12P-3014U, a product by Ube kosan Co.) were mixed well at room temperature and pelletized by use of a Brabender mixer having a jacket kept at 200° C.

The thus obtained pellets of the resin composition were tested for spontaneous ignition by injection into atmospheric air using an injection machine for molding in a magnetic field (Model TL-50MGS, manufactured by Tanabe Kogyo Co.) and the magnetic properties of the thus shaped plastic magnets were examined to give the results shown in Table 3.

The conditions for the injection molding were as follows: temperature of the cylinder was $C_1=210°$ C. at the hopper-side end and $C_2=300°$ C. at the other end; temperature of the nozzle was 290° C.; temperature of the metal mold was 110° C.; rotating velocity of the screw was 300 r.p.m.; and the magnetic field for orientation was 21 kOe.

TABLE 3

| Coating dye | Time to ignition, seconds | Magnetic properties $B_r$, kG | $_iH_c$, kOe | $(BH)_{max}$, MGOe |
|---|---|---|---|---|
| None | 0–1 | 4.3 | 6.5 | 2.5 |
| C.I. Sulfur Blue 7 | 5–7 | 4.4 | 6.9 | 4.0 |
| C.I. Acid Yellow 114 | 5–7 | 4.4 | 7.0 | 4.0 |
| C.I. Solvent Blue 36 | 5–7 | 4.4 | 7.0 | 4.1 |
| C.I. Solvent Black 7 | no ignition | 4.5 | 7.0 | 4.3 |
| C.I. Solvent Yellow 61 | no ignition | 4.5 | 7.0 | 4.5 |

Table 3 also includes the results obtained with the same magnetic alloy powder but not coated with the organic dye for comparative purpose in the same manner as above.

As is shown in the table, the resin composition with the uncoated magnetic alloy powder was instantaneously ignited when injected into the air while the dye coating of the magnetic alloy powder had an effect of remarkably retarding or preventing spontaneous ignition of the powder. Moreover, the hysteresis loop of the plastic magnet was distorted when the magnet was prepared with the uncoated magnet powder while a smooth hysteresis loop was obtained with each of the plastic magnets impregnated with the dye-coated magnetic alloy powder.

EXAMPLE 4

The same copper powder as used in Example 1 was coated with C.I. Solvent Black 7 in the same manner as in Example 1 to give a coating amount of 0.5% by weight.

A resin blend composed of 100 parts by weight of this dye-coated copper powder, 100 parts by weight of a polyvinyl chloride resin (TK-1000, a product by Shin-Etsu Chemical Co.), 2 parts by weight of tribasic lead sulfate and 50 parts by weight of dioctyl phthalate was milled in a 6-inch roller mill at 160° C. for 10 minutes and shaped into a rolled sheet. This sheet was further press-molded at 170° C. into a 1-mm thick sheet of which the electric volume resistivity was determined. For comparison, a similar sheet was prepared in the same manner except that the dye-coated copper powder was replaced with the same but uncoated copper powder in the same amount as above, of which the volume resistivity was determined. Further, the dye-coated and uncoated copper powders were heated in advance in air at 250° C. for 20 minutes before incorporation int the respective resin compositions and the volume resistivities of the resin sheets prepared with the thus heat-treated copper powders were determined. The results of the determination of the volume resistivities of the copper powder-impregnated resin sheets are shown in Table 4 below together with the volume resistivity of the resin sheet prepared without formulation of the copper powder.

TABLE 4

| Copper powder | | Volume resistivity, ohm · cm |
|---|---|---|
| Dye-coated | without heat treatment | $5 \times 10^9$ |
| | after heat treatment | $8 \times 10^9$ |
| Uncoated | without heat treatment | $4 \times 10^9$ |
| | after heat treatment | $2 \times 10^{12}$ |
| None | | $8 \times 10^{13}$ |

EXAMPLE 5

Dye-coating of the same magnetic alloy powder as used in Example 1 was undertaken by uniformly wetting about 1 g of the powder with 1 g of a 0.5% aqueous solution of C.I. Acid Black 2 followed by drying at 60° C. and then heating at 110° C.

The weight increase of the thus dye-coated alloy powder as well as the same powder before dye coating was examined in the lapse of days by keeping the powders at a constant temperature of 50° C. under a constant relative humidity of 90% to give the results shown in Table 5 below.

TABLE 5

| After keeping for | Weight increase, % | |
|---|---|---|
| | Dye-coated powder | Uncoated powder |
| 7 days | +0.01 | +0.04 |
| 14 days | +0.03 | +0.1 |
| 30 days | +0.06 | +0.5 |

EXAMPLE 6

Dye-coating of a magnetic alloy powder was undertaken by uniformly wetting a rare earth-cobalt based magnetic alloy powder (SEREM R-28, a product by Shin-Etsu Chemical Co.) with a 0.5% toluene solution of an organic dye indicated in Table 6 below in a volume to a ccoating amount also indicated in the same table, if necessary, with an additional volume of toluene followed by drying at 60° C. and then heating at 110° C. for 1 hour.

The thus dye-coated alloy powder was blended with a nylon resin and pelletized in the same manner with the same formulation as in Example 3.

In each of Experiments No. 8 to No. 11 and No. 13, the dye-coated alloy powder was further coated with a silicone fluid KF 96 (dimethyl silicone fluid, a product by Shin-Etsu Chemical Co.) or KP 358 (a modified silicone fluid, a product by the same company) with a 1% toluene solution of the silicone to give the coating amount shown in Table 6 followed by drying at 110° C. for 30 minutes. Experiment No. 2 in Table 6 was undertaken with a silicone-treated alloy powder before dye-coating and Experiment No. 1 was undertaken with the alloy powder as such without any surface treatment.

The pellets of each of the nylon resin-magnetic powder compositions were subjected to injection molding in the same conditions as in Example 3 and the spontaneous ignition of the composition by molding as well as the magnetic properties of the plastic magnets thus prepared were examined also in the same manner as in Example 3 to give the results shown in Table 6 below.

TABLE 6

| Exp. No. | Surface coating (coating amount, % by weight) Organic dye | Silicone | Screw rotation in injection, r.p.m. | Time to ignition, seconds | Properties of plastic magnet $B_r$, kG | $_iH_c$, kOe | $(BH)_{max}$, MGOe | Orientation, $B_r/B_{r'}$ | Squareness, $(BH)_{max}/(B_r/2)^2$ |
|---|---|---|---|---|---|---|---|---|---|
| 1 | None | None | 250 | 0–1 | 4.2 | 6.5 | 2.8 | 0.90 | 0.63 |
| 2 | None | KF 96 (0.5) | 280 | 1–5 | 4.4 | 6.9 | 4.0 | 0.95 | 0.83 |
| 3 | C.I. Sulfur Blue 7 (0.25) | None | 260 | 5–7 | 4.4 | 6.9 | 4.0 | 0.95 | 0.83 |
| 4 | C.I. Acid Yellow 114 (0.25) | None | 260 | 5–7 | 4.4 | 7.0 | 4.0 | 0.95 | 0.83 |
| 5 | C.I. Solvent Blue 36 (0.25) | None | 260 | 5–7 | 4.4 | 7.0 | 4.1 | 0.95 | 0.85 |
| 6 | C.I. Solvent Black 7 (0.25) | None | 260 | No ignition | 4.5 | 7.0 | 4.3 | 0.97 | 0.85 |
| 7 | C.I. Solvent Yellow 61 (0.25) | None | 260 | No ignition | 4.5 | 7.0 | 4.5 | 0.97 | 0.89 |
| 8 | C.I. Solvent Black 7 (0.2) | KF 96 (0.5) | 290 | No ignition | 4.5 | 7.0 | 4.6 | 0.97 | 0.91 |
| 9 | C.I. Solvent Yellow 61 (0.2) | KF 96 (0.5) | 290 | No ignition | 4.5 | 7.0 | 4.7 | 0.97 | 0.93 |
| 10 | C.I. Acid Yellow 114 (0.2) | KF 96 (0.5) | 290 | No ignition | 4.5 | 7.0 | 4.6 | 0.97 | 0.91 |
| 11 | C.I. Solvent Black 7 (0.1) | KP 358 (0.4) | 290 | No ignition | 4.5 | 7.0 | 4.6 | 0.97 | 0.91 |

TABLE 6-continued

| Exp. No. | Surface coating (coating amount, % by weight) Organic dye | Silicone | Screw rotation in injection, r.p.m. | Time to ignition, seconds | Properties of plastic magnet $B_r$, kG | $_iH_c$, kOe | $(BH)_{max}$, MGOe | Orientation, $B_r/B_r°$ | Squareness, $(BH)_{max}/(B_r/2)^2$ |
|---|---|---|---|---|---|---|---|---|---|
| 12 | C.I. Solvent Black 7 (0.1) | None | 250 | 2–4 | 4.4 | 6.9 | 3.8 | 0.95 | 0.79 |
| 13 | C.I. Solvent Black 7 (0.02) | KP 358 (0.5) | 290 | No ignition | 4.5 | 7.0 | 4.5 | 0.97 | 0.89 |

As is clear from the results shown in this table, the dyecoating is very effective in preventing spontaneous ignition of the composition by injection into atmospheric air while the composition prepared by incorporating the uncoated magnet powder was ignited instantaneously by injection. Further, the silicone treatment of the dye-coated magnet powder was effective in reducing the load on the injection machine with an increase in the velocity of rotation of the screw and in improving the squareness of the hysteresis loop of the plastic magnet.

EXAMPLE 7

The same magnetic alloy powder as used in the preceding example was coated in a similar manner with C.I. Solvent Black 7 in a coating amount of 0.1% by weight based on the alloy powder and the thus dye-coated magnetic alooy powder was further treated with a silicone KP 358. The surface-treated alloy powder was processed into plastic magnets with the same nylon resin as in the preceding exmple as the matrix but with varied amounts of impregnation of the magnetic powder in the range from 87 to 94% by weight. For comparison, the same magnetic alloy powder as such or after the treatment with a silicone KF 96 was processed into plastic magnets. Table 7 below gives the formulation, the rotating velocity of the screw of the injection machine, the result of the ignition test by injection and the magnetic properties of the plastic magnet in each of the experiments.

TABLE 7

| Exp. No. | Dye coating | Silicone coating, (% by weight) | Magnet powder loading, % by weight | Screw rotation at injection, r.p.m. | Time to ignition, seconds | Properties of plastic magnet $B_r$, kG | $_iH_c$, kOe | $(BH)_{max}$, MGOe | Orientation, $B_r/B_r°$ |
|---|---|---|---|---|---|---|---|---|---|
| 14 | No | None | 87 | 250 | 0–1 | 4.2 | 6.5 | 2.8 | 0.9 |
| 15* | No | None | 88 | <200 | 0–1 | — | — | — | — |
| 16 | No | KF 96 (0.5) | 87 | 280 | 1–5 | 4.3 | 6.9 | 4.0 | 0.95 |
| 17 | Yes | KP 358 (0.4) | 87 | 290 | No ignition | 4.5 | 7.0 | 4.6 | 0.97 |
| 18 | Yes | " | 90 | 290 | No ignition | 5.0 | 7.0 | 5.4 | 0.95 |
| 19 | Yes | " | 92 | 280 | No ignition | 5.4 | 6.9 | 6.2 | 0.92 |
| 20 | Yes | " | 94 | 270 | No ignition | 5.9 | 7.0 | 7.0 | 0.90 |

*No plastic magnet could be molded.

While the resin composition containing 88% by weight of the uncoated alloy powder could no longer be molded into a plastic magnet, the loading amount of the alloy powder in the resin composition could be increased up to 94% by weight to obtain satisfactory plastic magnets when the alloy powder was dye-coated and silicone-treated so that plastic magnets of greatly improved magnetic properties could readily be obtained.

EXAMPLE 8

A rare earth-cobalt based magnetic alloy (SEREM R-30, a product by Shin-Etsu Chemical Co.) in a powdery form was coated with C.I. Solvent Black 7 in a coating amount of 0.1% by weight in the same manner as in Example 6 followed by the treatment with a silicone KP 358 to give a coating amount of 0.5% by weight. This surface-treated magnetic alloy powder was blended with the same nylon resin as used in the preceding example in a weight ratio of 94:6 and pelletized.

The pellets were injection-molded in a magnetic field into a plastic magnet in the same manner as in the preceding example and the magnetic properties thereof were determined. Thereafter, the plastic magnet was crushed and then re-molded under the same molding conditions into a plastic magnet of which the magnetic properties were determined. This cycle of crushing and re-molding of the plastic magnet was repeated 4 times and the rotating velocity of the screw of the injection machine in each of the molding steps as well as the magnetic properties of the magnet shaped in each molding step were recorded as shown in Table 8 below (Experiments No. 21 to No. 25).

For comparison, the same test as above was undertaken with the same magnetic alloy powder but without surface treatment and in a blending ratio with the resin of 87:13 by weight (Experiments No. 26 and No. 27). The results of these comparative tests are also shown in Table 8.

As is clear from Table 8, a great decrease was noted by a single re-molding in the magnetic properties of the plastic magnet prepared by use of the surface-untreated magnetic alloy powder (Experiment No. 27) exhibiting a decrease in the squareness, which is thought to be a measure of the extent of degradation of the magnetic alloy powder, from 0.87 to 0.81 while the corresponding decrease in the inventive plastic magnet was very small from 0.88 to 0.85 even after 4 times repeated remolding (Experiments No. 21 to No. 25).

EXAMPLE 9

A powder of the same magnetic alloy as used in the preceding example, which was a 2:8 by weight mixture of a finer powder having an average particle diameter of 2 μm and a coarser powder having an average particle diameter of 40 μm by the Fischer's method, was coated with C.I. Solvent Black 7 to give a coating amount of 0.1% by weight in the same manner as in Example 6 followed by the treatment with a silicone fluid KP 358 to give a coating amount of 0.4% by weight on the surface. The thus surface-treaated magnetic alloy powder was blended with a polyphenylene sulfide resin (PPS P-4, a product by Philips Co.) in a proportion of 91:9 by weight.

TABLE 8

| Exp. No. | Number of re-molding, times | Screw rotation at injection, r.p.m. | Properties of plastic magnet | | | |
|---|---|---|---|---|---|---|
| | | | $B_r$, kG | $_iH_c$, kOe | $(BH)_{max}$, MGOe | Squareness, $(BH)_{max}/(B_r/2)^2$ |
| 21 | (initial) | 250 | 6.0 | 7.0 | 7.9 | 0.88 |
| 22 | 1 | 260 | 6.1 | 7.0 | 8.1 | 0.89 |
| 23 | 2 | 280 | 6.2 | 7.0 | 8.4 | 0.87 |
| 24 | 3 | 290 | 6.2 | 7.0 | 8.3 | 0.86 |
| 25 | 4 | 290 | 6.2 | 7.0 | 8.2 | 0.85 |
| 26* | (initial) | 250 | 4.6 | 7.0 | 4.6 | 0.87 |

TABLE 8-continued

| Exp. No. | Number of re-molding, times | Screw rotation at injection, r.p.m. | Properties of plastic magnet | | | |
|---|---|---|---|---|---|---|
| | | | $B_r$, kG | $_iH_c$, kOe | $(BH)_{max}$, MGOe | Squareness, $(BH)_{max}/(B_r/2)^2$ |
| 27* | 1 | 270 | 4.6 | 7.0 | 4.3 | 0.81 |

*Comparative test. See text.

The above prepared resin-magnetic powder composition was shaped into plastic magnets by injection molding by use of the same injection molding machine as used in Example 3 with somewhat modified conditions of: temperature $C_1=260°$ C.; $C_2=330°-360°$ C.; nozzle temperature=330°-360° C.; temperature of the metal mold=130° C.; the velocity of screw rotation=280 r.p.m.; and application of the magnetic field=15 kOe for 10 seconds.

No spontaneous ignition of the composition took place in this molding procedure and the resultant plastic magnets had magnetic properties of: $B_r=5.8$ kG; $_iH_c=7.0$ kOe; and $(BH)_{max}=7.2$ MGOe.

What is claimed is:

1. A plastic magnet which comprises a synthetic thermoplastic resin as the matrix and a magnetic alloy powder, the surface of the powder being coated with an organic dye in a coating amount in the range from 0.02 to 2% by weight, said powder being uniformly blended with the synthetic thermoplastic resin in a ratio of resin to powder in the range from 92:8 to 5:95 by weight.

2. The plastic magnet as claimed in claim 1 wherein the synthetic thermoplastic resin is a nylon resin or a polyphenylene sulfide resin.

3. The plastic magnet as claimed in claim 1 wherein the organic dye is C.I. Solvent Black 7.

4. The plastic magnet as claimed in claim 1 wherein the powder of a magnetic alloy coated with an organic dye is further coated with a silicone fluid before blending with the synthetic thermoplastic resin wherein the amount of the silicone fluid is in the range from 0.02 to 2% by weight of the powder of the magnetic alloy.

* * * * *